US006117802A

United States Patent [19]

Rohrbach et al.

[11] Patent Number: 6,117,802

[45] **Date of Patent: *Sep. 12, 2000**

[54] ELECTRICALLY CONDUCTIVE SHAPED FIBERS

[75] Inventors: Ronald P. Rohrbach, Hunterdon; Daniel E. Bause, Morristown; Peter D. Unger, Convent Station; Lixin Xue, Morristown; Russell A. Dondero, N. Arlington, all of N.J.; Gordon W. Jones, Toledo, Ohio

[73] Assignee: AlliedSignal Inc., Morristown, N.J.

[ * ] Notice: This patent is subject to a terminal disclaimer.

[21] Appl. No.: 08/960,307

[22] Filed: Aug. 28, 1997

[51] Int. Cl.[7] ..... D01F 6/00

[52] U.S. Cl. ..... 442/372; 442/338; 442/417; 428/372; 428/397; 428/398

[58] Field of Search ..... 428/397, 372, 428/376, 398, 399; 442/372, 338, 417

[56] References Cited

U.S. PATENT DOCUMENTS

| | | | |
|---|---|---|---|
| 4,255,487 | 3/1981 | Sanders | 428/368 |
| 4,303,733 | 12/1981 | Bulle et al. | 428/367 |
| 5,704,966 | 1/1998 | Rohrbach et al. | 428/398 |
| 5,713,971 | 2/1998 | Rohrach et al. | 55/233 |
| 5,744,236 | 4/1998 | Rohrbach et al. . | |
| 5,759,394 | 6/1998 | Rohrbach et al. . | |

FOREIGN PATENT DOCUMENTS

| | | |
|---|---|---|
| 63-152404 | 5/1988 | Japan . |
| 63-152404 | 6/1988 | Japan . |
| 1-266893 | 10/1989 | Japan . |
| 9-095864 | 4/1997 | Japan . |
| WO 97 15934 | 5/1997 | WIPO . |

OTHER PUBLICATIONS

Hawley Condensed Chemical dictionary, 1993 p. 574.

*Primary Examiner*—Newton Edwards

[57] ABSTRACT

A nonwoven filter media or mat (10) formed from a plurality of elongated generally hollow fibers (20) each having an internal cavity (22) which has an opening (24), smaller than the cavity width, to the fiber (20) surface and each retaining within the internal cavity (22) an electrically conductive material. The electrically conductive material can be a large number of relatively small conductive solid particles (18). The small solid particles (18), which can be graphite are permanently entrapped within the longitudinal cavities (22) of the fibers (20) without the use of an adhesive. The electrically conductive material can also be a selected liquid. In the case of a liquid, the wicking fibers (20) are filled with the selected conductive liquid through capillary action by which the individual wicking fibers (20) rapidly draw the selected electrically conductive liquid, with which they come into contact, through the internal cavities (22). The electrically conductive material, either solid particles or a liquid, remains within the wicking fiber cavities (22) and generally does not enter the space between the wicking fibers yet through the longitudinal openings (24).

5 Claims, 3 Drawing Sheets

ELECTRICALLY CONDUCTIVE SHAPED FIBERS

BACKGROUND OF THE INVENTION

1. Field of the Invention

This invention relates to fibers and more particularly to electrically conductive fiber produced by impregnating shaped wicking fibers with a conducting material.

2. Description of Prior Art

It is well known how to produce electrically conductive fibers. Such materials are principly made in two ways. The first relies on taking a polymeric fibrous material and heating it in a controlled environment until the fiber turn to a conducting form of carbon. The other approach is to simply form a thin coating of a conductive material on the outer-surface of a fiber. This can be done by simply burnishing graphite onto the fiber surface. These products suffer from either being very difficult to manafuacture or having low conductivities.

SUMMARY OF THE INVENTION

The present invention provides a electrically conductive flexible fiber wherein very small solid conductive particles, such as 0.3 micron graphite powder, are entrapped, without the use of an adhesive, within longitudinal cavities formed in the shaped wicking fiber. A plurality of the fibers are formed into a mat. The fibers have longitudinal extending internal cavities which have openings extending to the outer surface of the fibers. The fiber, the opening size and the small conductive particles to be entrapped are selected so that when the particles are forced into the longitudinal cavities they are permanently retained. The fibers selected provide a way to mechanically immobilize submicron powdered graphite particles without the use of an adhesive or binder. The powdered graphite becomes mechanically trapped within the longitudinal cavities of the fibers and is irreversibly bound. This approach can be extended to other conductive material which one would like to entrap within a fiber medium, including other solid particles of interest such as finely divided copper powder, silver powder or conducting polymer powders.

Electrically conductive liquids such as salt solutions can also be retained in the channels of the shaped wicking fibers to produce conductive fibers. The conductive liquids can be used with or without the solid conductive particles to produce the electrically conductive fibers. Other electrically conductive materials include conducting polymers, such as polyanaline and polypyrrole, ionic gels and metal powders can also be entrapped in the wicking fiber channels to produce an electrically conductive fiber strand.

This invention provides electrically conductive flexible fibers, each having a cross section with internal cavities having openings leading to the surface of the fiber, which are impregnated with electrically conductive small solid particles, an electrically conductive liquid and/or other electrically conductive materials. In the embodiment with a conductive powder, the internal cavities which extend longitudinal along the lengthwise direction of the fiber, are filled with a very small electrically conductive particulate material which is permanently retained in the cavities and will not spill out through the openings due, we believe, to mechanical restrictions. The fibers are dusted with the electrically conductive particles and then rolled, forcing the particles into the fiber cavities. The excess particles are physically removed by agitation and a strong air flow. The particles entrapped in the cavities are surprisingly stable and resistant to physical action. The present invention should have a significant cost savings over traditional electrical conductive graphite fibers.

BRIEF DESCRIPTION OF DRAWINGS

For a better understanding of the invention reference may be had to the preferred embodiments exemplary of the inventions shown in the accompanying drawings in which.

DETAILED DESCRIPTION OF THE PREFERRED EMBODIMENTS

Figure 1:
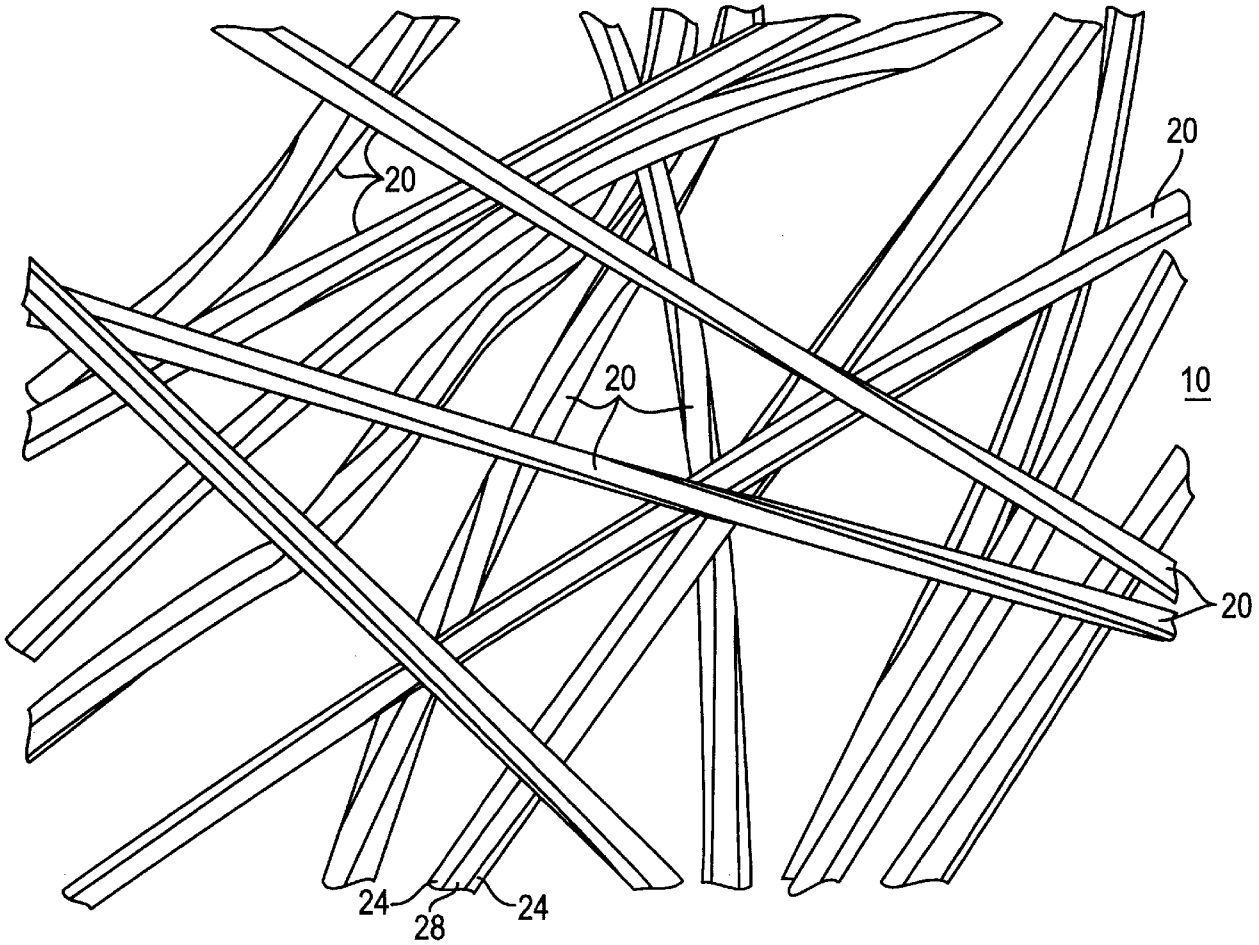
FIG. 1 is an illustration of a portion of a nonwoven fiber mat utilizing shaped wicking fibers which can be impregnated with fine electrically conductive powder particles according to the present invention.
Figure 2:
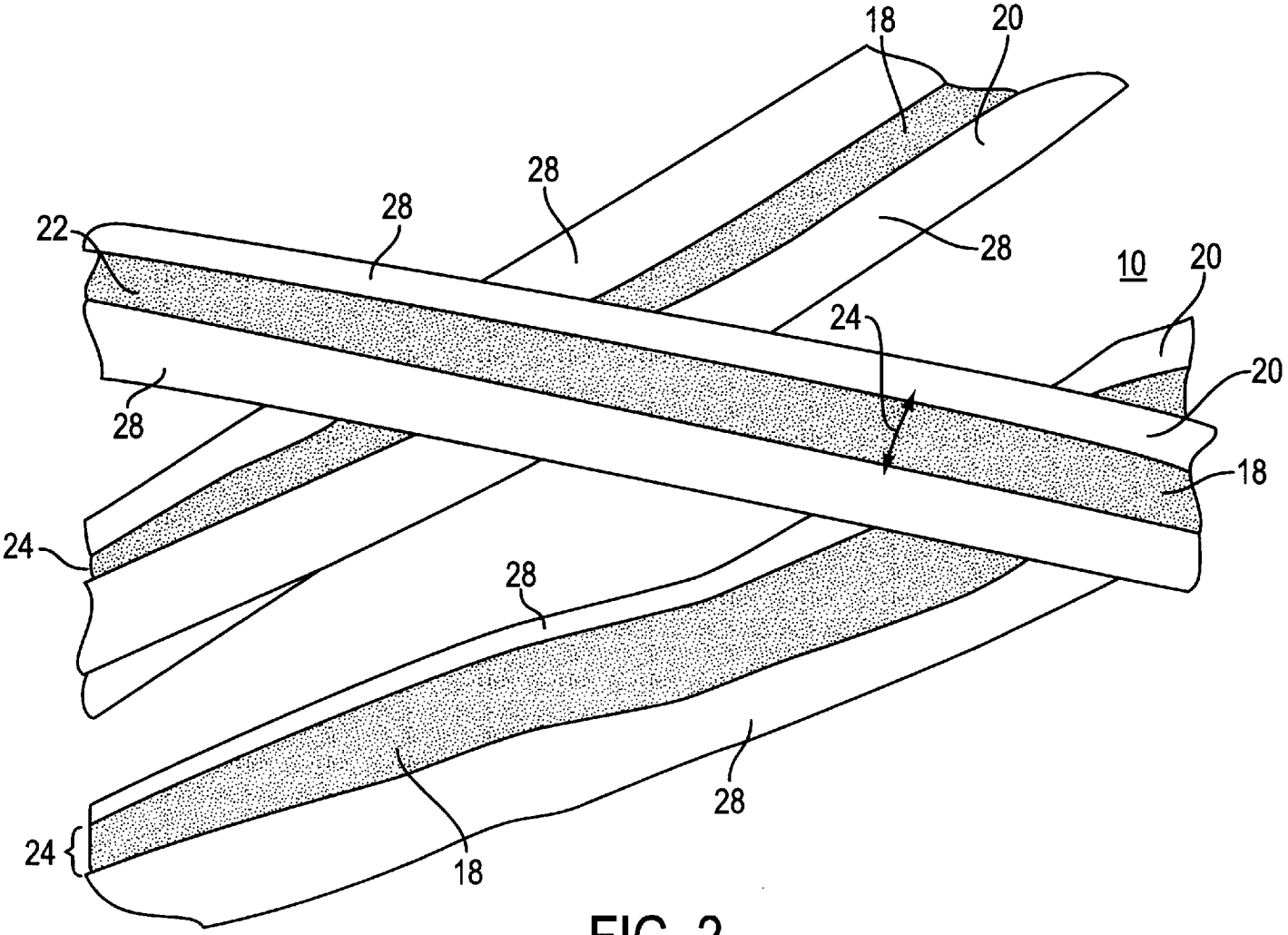
FIG. 2 is an enlarger view of a portion of the fiber mat shown in FIG. 1 utilizing shaped wicking fibers impregnated with the fine electrically conductive powder particles, or other electrically conductive materials, according to the present invention.

Referring now to the drawings and FIGS. 1 and 2 in particular there is shown a fiber mat 10 formed from a plurality of flexible fibers 20. The flexible fibers 20 are formed into the nonwoven fiber mat 10 which can be used as an electrically conductive filter element. Each fiber 20 includes an internal cavity 22 within which are disposed small graphite particles 18. A longitudinal opening 24 extends from each cavity 22 to the surface of each fiber 20. The multilobal fibers 20 are relatively small having a diameter of 250 microns to 10 microns or smaller. We have found that we can impregnate a conducting material into the channels 22 of the wicking fibers 20 to produce a fiber 20 with conducting properties. We have taken a polypropylene nonwoven media 10 and dry impregnated submicron graphite particles 18 into the channels 22 and this has resulted in a media with very good electrical conduction. The size of the graphite particles are approximately 0.3 microns. The fibers shown in FIGS. 1 and 2 are approximately 30 microns in diameter. The small graphite particles 18 become mechanically entrapped and remain within the fiber cavities 22 and generally do not enter the space between the fibers 20. The size of opening 24 is selected so when graphite particles 18 are disposed in cavity 22 they are essentially permanently entrapped and cannot easily be removed. Preferably, the graphite particles 18 are very small generally being less than 1 micron across. Other electrical conducting materials, including solid particles, conducting liquids, conducting polymers, such as polyanailine and polypyrrole, ionic gels and metal powders can also be entrapped in the wicking fiber channels 22 to produce an electrically conductive fiber strand.

Figure 3:
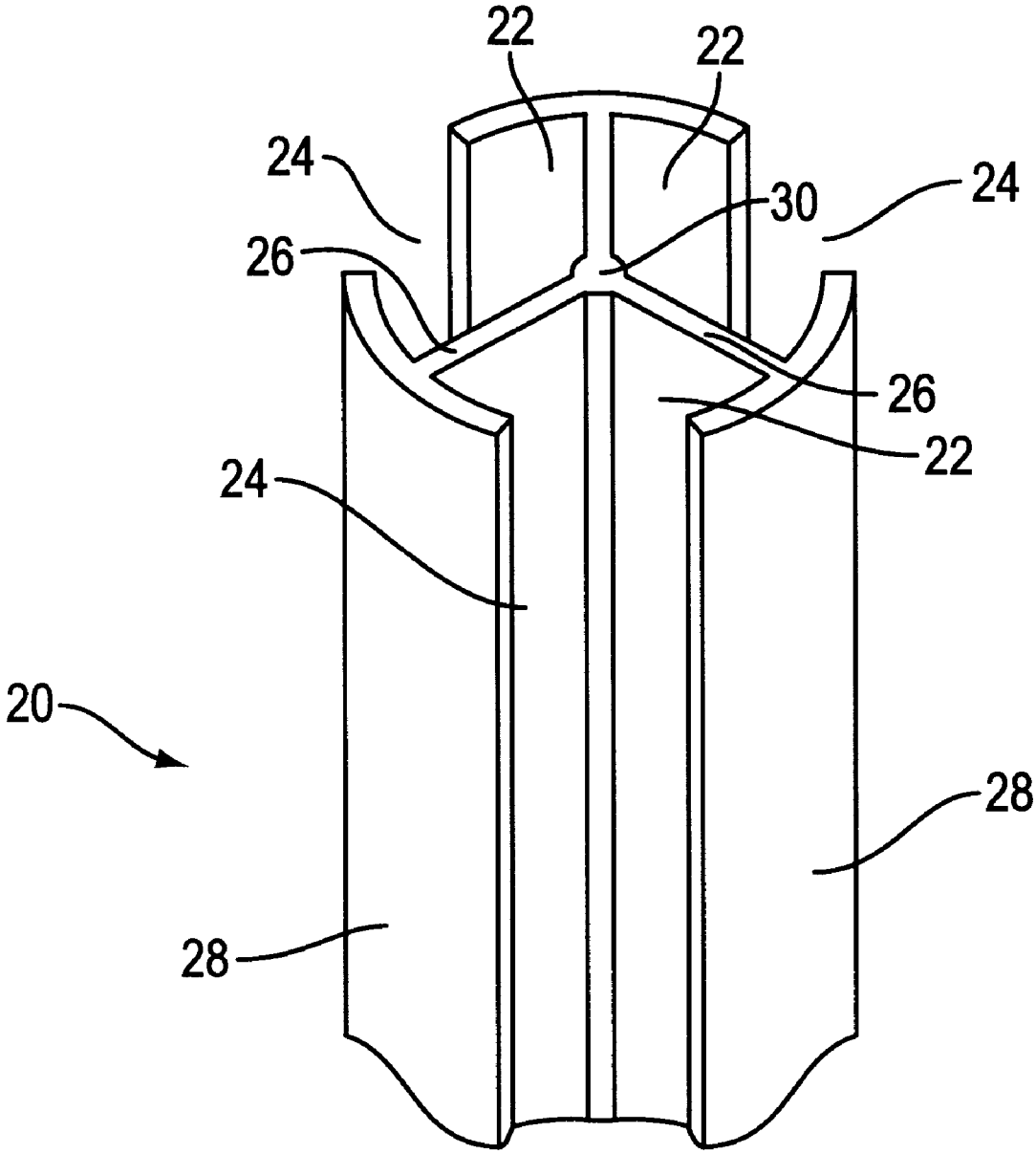
FIG. 3 is a perspective view showing a wicking fiber which is suitable for practicing the present invention.

A generally hollow fiber 20 which is suitable for practicing this invention is disclosed in U.S. Pat. No. 5,057,368 and is shown in FIG. 3. This patent discloses a trilobal or quadrilobal fiber formed from thermoplastic polymers wherein the fiber has a cross-section with a central core and three or four T-shaped lobes 26. The legs of the lobes intersect at the core 30 so that the angle between the legs of adjacent lobes is from about 80 degrees to 130 degrees. The fiber 20 as illustrated in FIG. 3 is formed as an extruded strand having three hollow interior longitudinally extending cavities 22 each of which communicates with the outer strand surface by way of longitudinal extending slots 24 which are defined between the outer ends of the T-shaped lobes.

As can be clearly seen in FIG. 2 the graphite particles 18 are retained within the individual cavities 22 without spilling out into the inter fiber voids. The fibers 20 strongly retain the graphite particles 18 within the cavities 22 so that the particles 18 will not shake off and the fiber mat 10 retains the particles 18 when touched or handled. In a filter mat 10 of such fibers 20 the area between the individual strands remains relatively free of the graphite particles 18 with which the internal cavities 22 of each fiber 20 are filled. The filter mat 10 fibers 20 may be made of one or more types of material such as polyamides, polyesters, or polyolefins. The three T-shaped cross-section segments 26 may have their outer surface 28 curved, as shown, or the outer surface may also be straight. While the fiber 20 is depicted as three lobed other number of lobes are suitable. In addition other internal cavity fibers with C-shapes or other cross sections may also be suitable for retaining the small graphite particles 18 provided the opening from the cavity 22 is sized to retain the particles 18 within the fiber interior.

In using electrically conductive particles 18 to form the conductive fiber mat 10, the solid particles 18 are aggressively rubbed into the fibers 20. The procedure used for dry impregnation is to take the fibers 20 and liberally dust them with the graphite powder 18. The particles 18 of the graphite powder have a diameter of less the one half the fiber 20 cross sectional diameter. The powder graphite particles 18 are rolled into the fiber 20 several times. The excess graphite powder is physically removed by agitation aided by a strong air flow. The graphite powder particles 18 which remain within the cavities 22 are surprisingly stable and resistant to physical action. We believe it is a keystone type mechanical entrapment effect which so tenaciously hold the particles 18 within the fibers 20. The particles 18 seem to engage one another and do not spill from the cavities 22 through opening 24. We tried impregnating trilobal fiber in which the outer ends or caps of the lobes 26 were removed. Very little graphite particles were retained by such fibers.

Basically, one application of this invention provides a simplified and low cost version of a graphite fiber element. Instead of starting with an organic polymer fiber which is then heated to obtain a graphite fiber we start with a generally hollow shaped fiber 20 and impregnate it with powdered graphite 18. While this invention has been described using graphite particles other powders formed of electrically conductive organic particles or electrically conductive inorganic particles, which are within the required size range, can be used. A few other examples of uses for the invention are: an electrically conductive fuel filter media, a conductive connecting bridge of batteries, fuel cells, electrodes for electroplating, electrodes for electrochemical synthesis and a media for electrostatic precipitators.

EXAMPLES

Examples for Conducting Wicking Fiber

Example 1

Formation of Graphitic Impregnated Fibers:

Example 1—Graphite Impregnation

Two samples of impregnated polypropylene media were tested, one with a trilobal strand 20 configuration and the other with a round cross section. A small preweighed patch of the media was immersed in a great excess of finely divided powder graphite. This media was virgorously shaken with the powder and simulatenously rubbed, working the graphite into the fiber. The media was then removed and any excess was blown off using high pressure air. Both media samples were then weighed and their conductivity tested using a conventional ohmmeter with the probes 2 cm apart. Levels of graphite within the triad fiber have been measured up to 70% by weight. PET fibers have also been successfully impregnated with fine metal powders such as copper and stainless steel which show increased conductivity.

| | Round Cross Section | Triad Cross Section |
|---|---|---|
| Graphite loading | 3% | 30% |
| Conductivity | 135 ohms | 0.6 ohms |

This clearly shows the wicking fibers 20 when impregnated with an electrically conductive materials produce electrically conductive fibers. The electrically conductive material is retained within the channels 22 of wicking fibers 20 while the round cross section fibers retain little of the electrically conductive material.

Examples 2–4

Formation of Polypyrrole Fibers

Example 2—From Liquid Phase:

Under nitrogen atmosphere, a trilobal wicking fiber pad 10 (0.221 g, 2 inches in diameter) was first impregnated with liquid pyrrole to 0.95 g and then soaked and squeezed in excess amount of 20% FeCl3 solution (about 3.5 g). When the fiber pad 10 turned completely black in about 10 minutes, the excess liquid was removed by careful squeezing. After washed in 50 ml of de-ionized water and dried in a evaporation oven at 93° C. for 20 minutes, the sample weighed 0.380 g. Under microscope, a homogenous black fiber mat of polypyrrole fiber can be clearly identified. The polypyrrole fiber was impregnated in the channels 22 of the wicking fiber 20. The conductivity of the impregnated fiber mat 10 was measure under 4-point probe method as 2.2e-4 s/cm. The conductivity of the impregnated mats 10 described in these examples 2, 3 and 4 are sensitive to the contact between the fibers 20 in the mats 10 while carrying out this measurement. The number will be higher if the measurement is done on individual fibers 20.

Example 3—From Gas Phase:

A trilobal wicking fiber pad 10 (0.221 g, 2 inches in diameter) was first soaked and squeezed in excess amount of 20% FeCl3 solution and the excess was removed by careful squeezing. The obtained brownish pad 10 was first dried by blowing with 1.5 CFM nitrogen stream for 30 minutes and then exposed to saturate vapor of pyrrole carried by the same nitrogen stream which passed through a 2-necked container with liquid pyrrole. In about an hour, the wicking fiber pad 10 turned completely into the dark color of polypyrrole. After washing and drying as in example 1, the pad weighed 0.350 g and had a conductivity of 2.5e-4 s/cm.

Example 4—Enforced with Graphite Powder

A trilobal wicking fiber pad 10 (0.221 g, 2 inches in diameter) was first dry impregnated with graphite powder to 0.250 g. The conductivity of this impregnated mat 10 was determined as 1.5e-5 s/cm. This mat was then soaked and squeezed in excess amount of 20% FeCl3 solution and the excess was removed by careful squeezing. The obtained pad 10 was first dried by blowing with 1.5 CFM nitrogen stream for 30 minutes and then exposed to saturate vapor of pyrrole carried by the same nitrogen stream which passed through a 2-necked container with liquid pyrrole. In about an hour, the wicking fiber pad 10 turned completely into the dark color of polypyrrole. After washing and drying as in example 1, the pad weighed 0.404 g and has a conductivity of 1.17e-3 s/cm.

What is claimed is:

1. A fiber mat comprising:

a plurality of elongated fibers each having a longitudinally extending internal cavity including an opening from the internal cavity to the outer fiber surface;

a fine powder made from electrically conductive particles which are smaller than the opening disposed within the internal cavities of said plurality of elongated fibers; and, said fine powder particles being of such a size, shape and makeup that it is securely retained within the internal cavity.

2. A fiber mat as claimed in claim 1 wherein each elongated fiber is less than 250 microns in diameter and the majority of fine powder particles are less than 20 microns in size.

3. A fiber mat as claimed in claim 1 wherein the fine powder particles comprise graphite.

4. A fiber mat as claimed in claim 1 wherein the fine powder particles comprise metal.

5. A fiber mat as claimed in claim 1 wherein a plurality of internal cavities, each including an opening to the outer fiber surface, are formed in each fiber.

* * * * *